United States Patent [19]

Yamashita

[11] 4,405,177

[45] Sep. 20, 1983

[54] APPARATUS FOR FINISHING SURFACES

[75] Inventor: Hiroyuki Yamashita, Tokorozawa, Japan

[73] Assignee: Y K Trading Kabushiki Kaisha, Tokyo, Japan

[21] Appl. No.: 255,078

[22] Filed: Apr. 17, 1981

[51] Int. Cl.[3] ..... B24B 23/00; E01C 23/00

[52] U.S. Cl. ..... 299/41; 51/170 PT; 175/338

[58] Field of Search ..... 299/40, 86, 41, 39; 51/177, 170 PT, 176; 175/338, 350, 374, 365, 375

[56] References Cited

U.S. PATENT DOCUMENTS

| | | | |
|---|---|---|---|
| 1,836,638 | 12/1931 | Wright et al. | 175/350 X |
| 2,024,764 | 12/1935 | Hill | 299/41 |
| 2,244,617 | 6/1941 | Hannum | 175/375 X |
| 3,221,619 | 12/1965 | Erickson | 299/41 X |
| 3,695,723 | 10/1972 | Kita et al. | 299/86 X |
| 4,155,596 | 5/1979 | Brejcha | 299/41 X |

OTHER PUBLICATIONS

Japanese Design Registration No. 386,605, Oct. 8, 1974.

*Primary Examiner*—Ernest R. Purser
*Attorney, Agent, or Firm*—Flynn, Thiel, Boutell & Tanis

[57] ABSTRACT

An apparatus for finishing a surface, e.g., for erasing line markings on a road, includes a rotor assembly rotatably mounted on a wheeled frame and including a rotor drivable to rotate about its own axis and a plurality of rotary scrapers mounted in angularly spaced relation on the rotor for free rotation about their own axes extending off center with respect to the axis of the rotor. A plurality of radial scraper tips are mounted circumferentially on each of the rotary scrapers for scraping contact with the surface to be finished. When the rotor assembly is driven, the rotary scrapers are caused to rotate due to frictional engagement with the surface, whereupon the scraper tips are forced to move in arcuate paths while in contact with the surface, to thereby scrape off portions of the surface.

9 Claims, 9 Drawing Figures

APPARATUS FOR FINISHING SURFACES

BACKGROUND OF THE INVENTION

1. Field of the Invention

The present invention relates to an apparatus for finishing surfaces, e.g., for removing or erasing line markings on a road.

2. Prior Art

Known surface-finishing apparatus comprise a rotor assembly including a drivable rotor and a plurality of toothed rotary scrapers freely rotatable on shafts mounted on the rotor and extending radially therefrom in alignment with the central axis of the rotor. One form of such rotor assembly is shown in Japanese Design Registration No. 386,605 published on Oct. 8, 1974. In operation, the rotor is driven to rotate about its own axis, causing the rotary scrapers to rotate while in contact with a surface to be treated. Since the scraper teeth of the rotary scrapers are held merely in point-to-point contact with the surface, they are poor in scraping efficiency, especially when the surface to be treated is relatively soft and sticky under intensive heat as during summer. The rotor assembly rotates at approximately 1,600 RPM and is heavy (about 1 kg), and hence is subjected to great centrifugal forces which tend to damage the shafts and bearings. The prior rotary scrapers are normally four or more in number, which frequently fail to provide neat contact with a rough surface to be finished.

SUMMARY OF THE INVENTION

A rotor assembly for a surface-finishing apparatus includes a drivable rotor and a plurality of rotary scrapers mounted at angularly spaced locations on the rotor for free rotation about their own axes extending off center with respect to the axis about which the rotor is rotatable. A plurality of scraper tips are mounted radially on the circumference of each of the rotary scrapers, which when the rotor is driven are caused to rotate, forcing the scraper tips to scrape off portions of a surface being finished as the scraper tips move along arcuate paths while in contact with the surface. The axes of rotation of the rotary scrapers are spaced from the axis of rotation of the rotor either forwardly or rearwardly with respect to the direction of rotation of the rotor. The scraper tips may be cylindrical or rectangular parallelpiped in shape, and may be arranged in two or three rows which may be aligned or staggered axially of the rotary scraper.

It is an object of the present invention to provide a surface-finishing apparatus which is highly efficient in finishing a surface.

Another object of the present invention is to provide a surface-finishing apparatus which is capable of finishing a relatively wide area at a time.

Still another object of the present invention is to provide a surface-finishing apparatus having rotary scrapers which are easily replaceable and when in operation remain secured to a rotor for a reliable surface finish.

Still another object of the present invention is to provide a surface-finishing apparatus having rotary scrapers which in use will be held in intimate contact with a surface being finished.

The above and other objects, features and advantages of the present invention will be described with reference to the accompanying drawings which illustrate preferred embodiments of the present invention by way of example.

DETAILED DESCRIPTION

Figure 1:
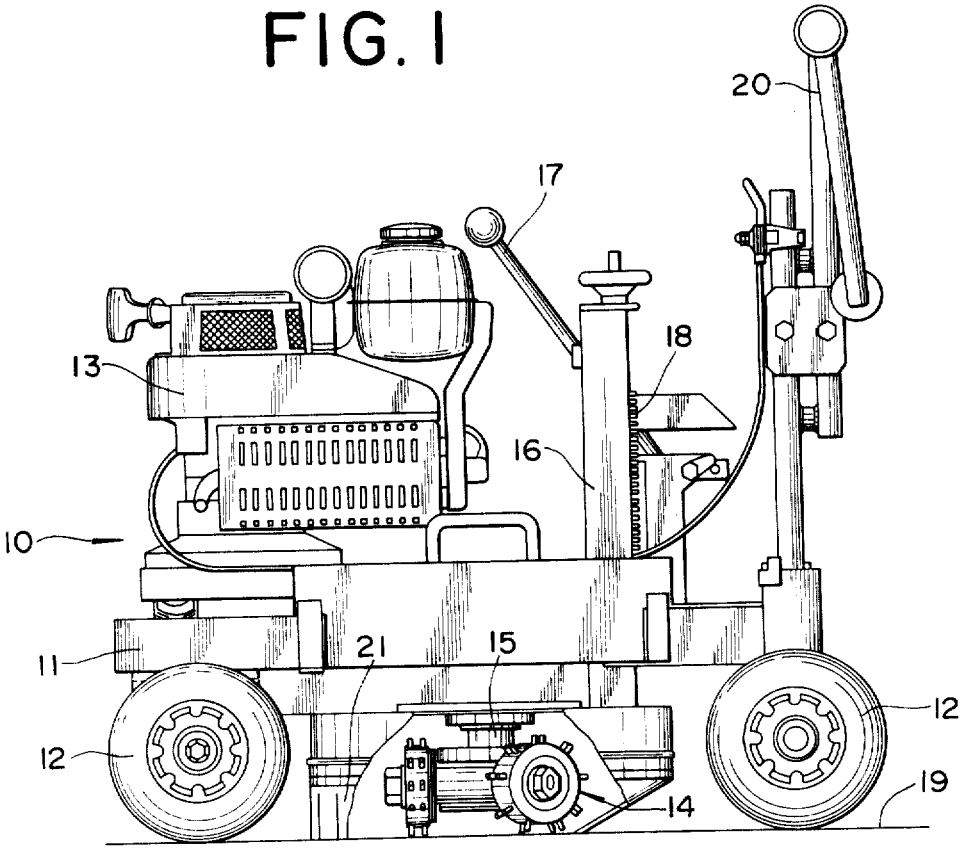
FIG. 1 is a side elevational view of a surface treating apparatus according to the present invention.

As shown in FIG. 1, an apparatus 10 for finishing a surface, e.g., for erasing line markings on a road, comprises a frame 11, a plurality of wheels 12 rotatably mounted on the frame 11 and held in contact with a surface 19 to be finished for keeping the frame 11 spaced from the surface 19, an engine 13 mounted on the frame 11, and a rotor assembly 14 rotatably mounted by a shaft 15 on the frame 11 and disposed between the frame 11 and the surface 19, the rotor assembly 14 being drivable by the engine 13 through the shaft 15 to rotate in a plane substantially parallel to the surface 19.

A vertical adjustment mechanism 16 on the frame 11 is responsive to action of a tiltable handle 17 for adjusting the rotor assembly 14 in vertical position with respect to the surface 19, the rotor assembly 14 being normally urged downwardly by a spring 18. A steering handle 20 is operatively connected to one or two of the wheels 12 to direct the apparatus 10 while moving on the surface 19. A rubber skirt 21 hangs downwardly from the frame 11 in surrounding relation to the rotor assembly 14 for preventing scraped pieces or debris from being scattered around.

Figure 2:
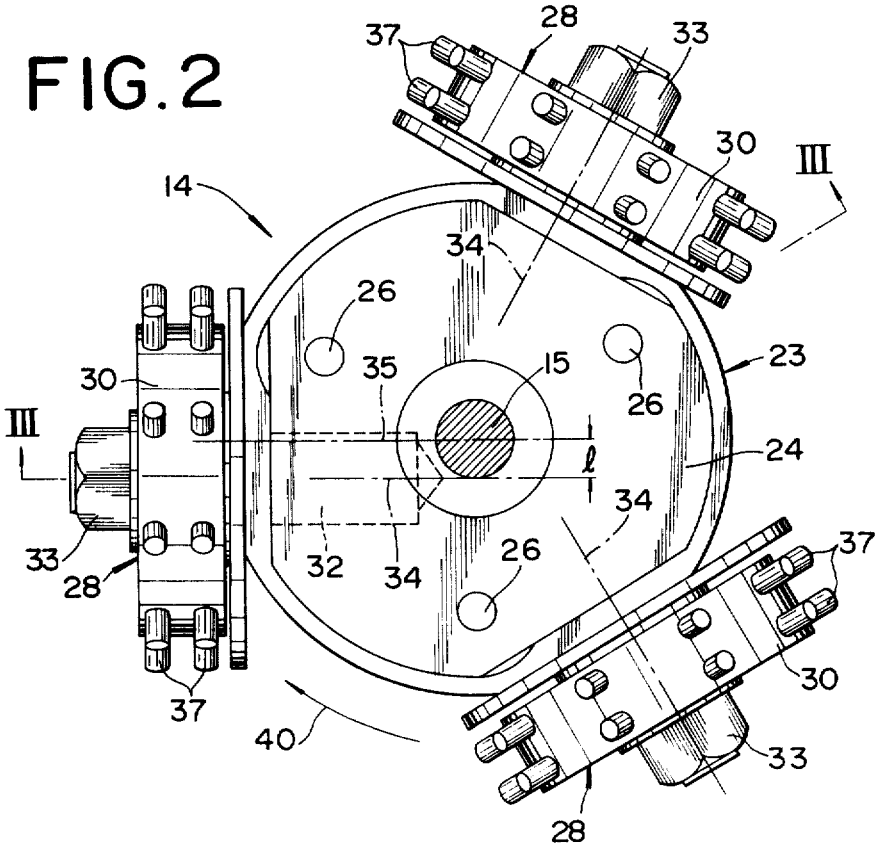
FIG. 2 is a plan view of a rotor and rotary scrapers attached thereto.
Figure 3:
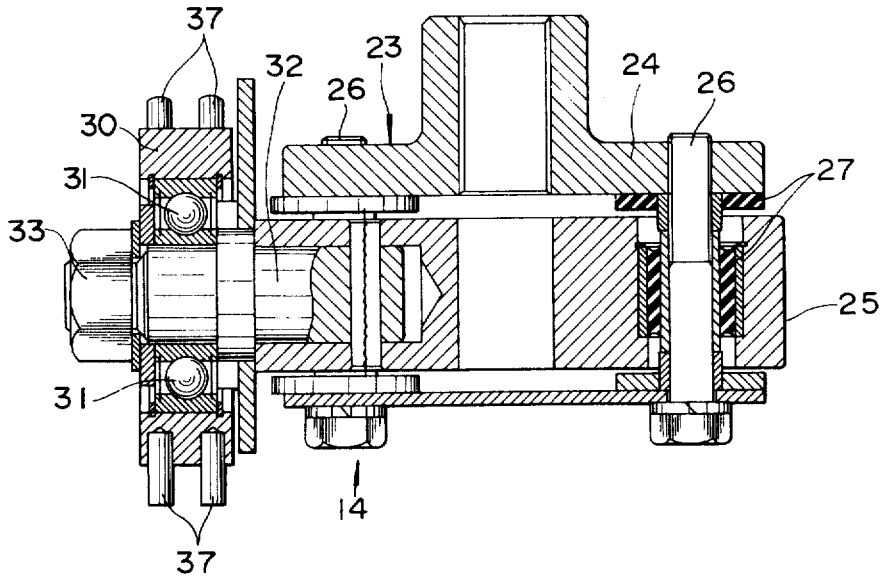
FIG. 3 is a cross-sectional view taken along line III—III of FIG. 2.

As illustrated in FIGS. 2 and 3, the rotor assembly 14 comprises a substantially circular rotor 23 including an upper member 24 (FIG. 3) for connection to the shaft 15 and a lower member 25 connected to the upper member 24 by bolts 26 with rubber dampers 27 interposed therebetween.

A plurality (three in the illustrated embodiment) of circular rotary scrapers 28 are rotatably mounted circumferentially on the rotor 23 and spaced substantially 120 degrees apart from each other as best shown in FIG. 2. The rotary scrapers 28 are freely rotatably in planes substantially normal to the plane in which the rotor 23 is rotatable.

Each of the rotary scrapers 28 comprises an annular member 30 disposed freely rotatably on a roller bearing 31 mounted around a radial stud or shaft 32 fixed to the lower rotor member 25. The rotor assembly 28 is removably mounted on the stud 32 by a nut 33 threaded over a distal end of the stud 32.

As best illustrated in FIG. 2, each of the shafts 32 has a central axis 34 which is off center with respect to the central axis of the shaft 15 and which is parallel to but spaced from the radial line 35 and hence is spaced from the central axis of the shaft 15 by a distance l rearwardly with respect to a direction indicated by the arrow 40 in which the rotor assembly 14 rotates.

Figure 4:
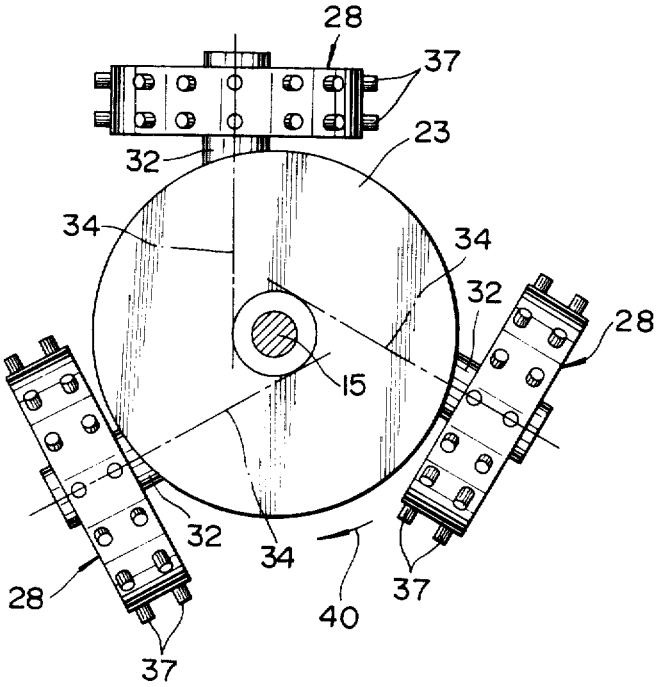
FIG. 4 is a plan view of the rotor with the rotary scrapers mounted thereon.

A plurality of scraper tips or teeth 37 of hard metal are embedded circumferentially in each of the annular members 30 of the rotary scrapers 28 at angularly spaced locations and extend radially outwardly of the annular member 30. In the embodiment of FIGS. 2 and 4, the scraper tips 37 are cylindrical in shape and arranged in a pair of rows aligned axially of the rotary scraper 28.

Figure 5:
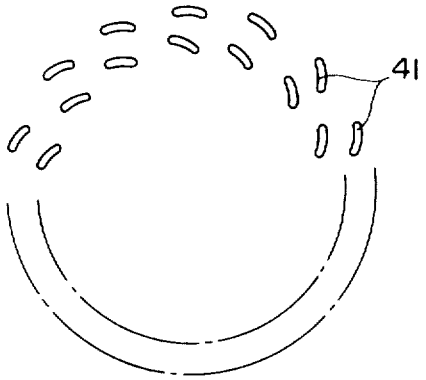
FIG. 5 is a plan view of scratches formed on a surface by scraper tips.

In operation, the engine 13 is started to rotate the rotor assembly 14 and the apparatus 10 is moved along until it arrives at an area or surface to be finished where as an example, a line marking to be removed is coated on a road. Then, the tiltable handle 17 is manipulated to lower the rotor assembly 14 into contact with the line marking. Upon contact of the scraper tips 37 with the line marking, each of the rotary scrapers 28 are caused to rotate due to frictional engagement with the marking surface, whereupon the scraper tips 37 are forced to bite into the line marking. More specifically, with the studs 32 disposed off center with respect to the shaft 15, each of the rotary scrapers 28 is forcibly revolved around the rotor 23 at an angle to the tangential line at the stud 32, causing the scraper tips 37 to be dragged in the line marking along arcuate paths, leaving oblong scratches or scraped areas 41 (FIG. 5) in the line marking. By moving along the rotor assembly 14, the line marking is scraped off substantially completely in a short period of time when there are produced as many scratches 41 as the scraper tips 37 repeatedly sweep away marking pieces.

The rotary scrapers 28 are subjected to forces tending to urge themselves radially inwardly of the rotor 23 while in forced rotation, such forces act to counterbalance centrifugal forces applied to the rotary scrapers 28 when the rotor assembly 14 rotates at high speeds, thereby preventing excessive forces from being imposed on the rotary scrapers 28 and the roller bearings 31.

The rotary scrapers 28 are three in number according to the illustrated embodiment, an arrangement which is especially advantageous in that an intimate degree of contact is assured between the rotor assembly 14 and a surface to be treated, even if such a surface is a little bumpy.

Figure 6:
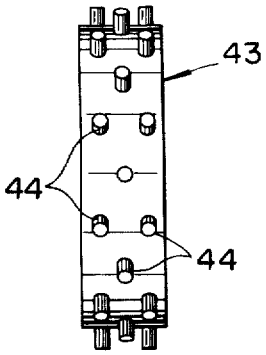
FIGS. 6 through 8 show modified rotary scrapers.

FIG. 6 illustrates a rotary scraper 43 according to another embodiment, which has cylindrical scraper tips or teeth 44 arranged in three rows, one of which is staggered axially of the rotary scraper 43.

Figure 7:
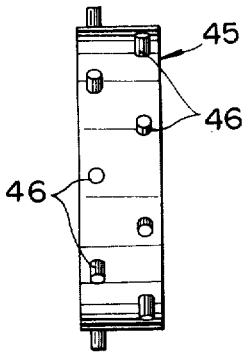

As shown in FIG. 7, a rotary scraper 45 according to still another embodiment has cylindrical tips or teeth arranged in two rows staggered axially of the rotary scraper 45.

Figure 8:
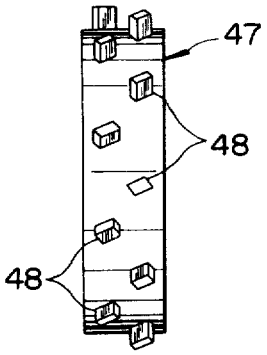

A rotary scraper 47 (FIG. 8) according to still another embodiment has a pair of staggered rows of scraper tips or teeth 48 which are rectangular parallelepiped in shape and inclined with respect to an axial direction of the rotary scraper 47.

Figure 9:
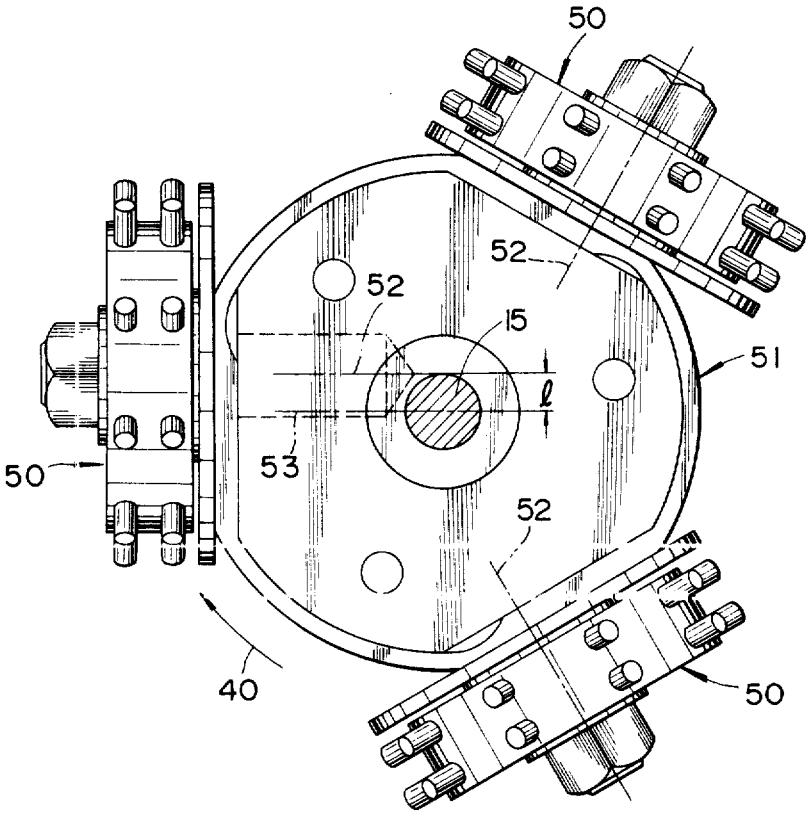
FIG. 9 is a plan view of a rotor and rotary scrapers mounted thereon according to another embodiment.

According to an embodiment shown in FIG. 9, three rotary scrapers 50 are mounted at angularly spaced positions on a rotor 51 each for free rotation about its own axis 52 which is off center with respect to the rotor 51 and is spaced from a parallel radial line 53 extending through the center of the shaft 15 by the distance l forwardly with respect to the direction of rotation 40 of the rotor 51. While such an arrangement allows stronger undue forces to be applied to the rotary scrapers 50 radially outwardly of the rotor 51 than the embodiment of FIGS. 2 and 3, it still is as effective in scraping ability.

The distance l may be selected as desired at the production stage to meet conditions of surfaces to be finished, RPM at which the rotor is to be rotated, degrees of how fast the surface should be finished, and other various considerations or requirements.

Although certain preferred embodiments have been shown and described in detail, it should be understood that various changes or modifications may be made therein without departing from the scope of the appended claims.

What is claimed is:

1. A rotor assembly for finishing a surface, comprising:

a rotor drivably rotatable within a first plane which is substantially parallel to the surface to be finished, said rotor being drivably rotatable about a first axis which is substantially perpendicular to said surface;

three rotary scrapers individually supported on said rotor for free rotation in second planes which are substantially perpendicular to said first plane, said three rotary scrapers being disposed in a circular array about said first axis so that said three rotary scrapers are angularly spaced substantially 120° apart from one another;

each said rotary scraper being supported for free rotation on said rotor about a second axis which is substantially perpendicular to but does not intersect said first axis, said second axis being positioned closely adjacent and in parallel relationship to a radial line which projects perpendicularly outwardly from and intersects said first axis, said second axis being spaced rearwardly from the respective adjacent radial line with respect to the direction of rotation of said rotary;

each said scraper having a plurality of scraper tips mounted thereon circumferentially therearound, said scraper tips extending radially from the respective scraper for scraping contact with the surface;

said rotor being of a substantially cylindrical construction and including upper and lower rotor portions connected together by threaded fasteners with elastomeric dampers being interposed between said upper and lower rotor portions, said rotary scrapers being freely rotatably supported on said lower rotor portion; and drive shaft means nonrotatably coupled to said upper rotor portion.

2. A rotor assembly according to claim 1, wherein said threaded fasteners includes a plurality of bolts which extend through respective openings in one of the rotor portions for fixed connection with the other rotor portion, and said elastomeric dampers including a first rubberlike damper disposed within the respective opening so as to be interposed between the bolt and said one rotor portion, and a second rubberlike damper interposed axially between said upper and lower rotor portions.

3. An apparatus for finishing a surface, comprising:

a frame;

a plurality of wheels disposed in rolling engagement with said surface and rotatably mounted on said frame for movably maintaining said frame spaced upwardly from said surface;

a rotor drivably rotatably supported on said frame for rotation in a first plane substantially parallel to said surface to be finished, said rotor being drivably rotatable about a first axis which is substantially perpendicular to said surface;

a plurality of rotary scrapers supported on said rotor for free rotation in second planes which are substantially perpendicular to said first plane, said plurality of rotary scrapers being disposed within a circular array about said first axis with each said rotary scraper being freely rotatably supported on said rotor for rotation about a second axis which is substantially perpendicular to but does not intersect said first axis, said second axis being positioned substantially parallel to and closely adjacent but spaced from a radial line which perpendicularly intersects said first axis;

a plurality of scraper tips mounted on each of said rotary scrapers and extending radially therefrom for scraping contact with the surface;

means on said frame for drivingly rotating said rotor; and means on said frame for vertically adjusting said rotor relative to said frame for positioning said rotor in operative engagement with the surface to be finished.

4. An apparatus according to claim 3, wherein said rotor is of substantially cylindrical construction and said rotary scrapers are positioned radially outwardly from but closely adjacent the circumferential periphery of said rotor.

5. An apparatus according to claim 4, wherein said rotor has only three said rotary scrapers mounted thereon in substantially equally angularly spaced relationship around said first axis.

6. An apparatus according to claim 3, wherein said rotor has upper and lower substantially cylindrical portions positioned in axially adjacent relationship with one another, said upper cylindrical rotor portion being connected to said driving means, and fastening means connected between said upper and lower rotor portions for rotatably drivingly connecting same together, said fastening means including elastomeric damper means interposed between said upper and lower rotor portions.

7. An apparatus according to claim 6, wherein there are only three said rotary scrapers mounted on said rotor in angularly spaced relationship about said first axis, said rotary scrapers being freely rotatably supported on said lower rotor portion and positioned radially outwardly from but closely adjacent the circumferential periphery of said lower rotor portion.

8. An apparatus according to claim 7, wherein said second axis is spaced rearwardly from its respective radial line relative to the direction of rotation of the rotor.

9. An apparatus according to claim 3, wherein said second axis is spaced rearwardly from its respective radial line relative to the direction of rotation of the rotor.

* * * * *